US009693132B2

(12) United States Patent
Goossens

(10) Patent No.: US 9,693,132 B2
(45) Date of Patent: Jun. 27, 2017

(54) LOUDSPEAKER WITH A HELMHOLTZ RESONATOR

(71) Applicant: PSS BELGIUM N.V., Dendermonde (BE)

(72) Inventor: Karel Goossens, Dendermonde (BE)

(73) Assignee: PSS BELGIUM N.V., Dendermonde (BE)

( * ) Notice: Subject to any disclaimer, the term of this patent is extended or adjusted under 35 U.S.C. 154(b) by 0 days.

(21) Appl. No.: 14/907,900

(22) PCT Filed: Aug. 1, 2014

(86) PCT No.: PCT/EP2014/066651
§ 371 (c)(1),
(2) Date: Jan. 27, 2016

(87) PCT Pub. No.: WO2015/015004
PCT Pub. Date: Feb. 5, 2015

(65) Prior Publication Data

US 2016/0165335 A1 Jun. 9, 2016

(30) Foreign Application Priority Data

Aug. 2, 2013 (GB) ..... 1313883.9

(51) Int. Cl.
*H04R 1/02* (2006.01)
*H04R 1/28* (2006.01)
(Continued)

(52) U.S. Cl.
CPC ..... *H04R 1/2842* (2013.01); *H04R 1/2849* (2013.01); *H04R 1/2873* (2013.01);
(Continued)

(58) Field of Classification Search
USPC ..... 381/334, 345, 346; 181/157
See application file for complete search history.

(56) References Cited

U.S. PATENT DOCUMENTS 5,357,586 A * 10/1994 Nordschow ..... H04R 9/022 181/199
6,493,456 B1 12/2002 Hansson
(Continued)

FOREIGN PATENT DOCUMENTS

EP 1883268 A2 1/2008

OTHER PUBLICATIONS

EPO, International Search Report and Written Opinion for PCT Patent Application PCT/EP2014/066651, Oct. 20, 2014.

*Primary Examiner* — Sunita Joshi
(74) *Attorney, Agent, or Firm* — NK Patent Law, PLLC

(57) ABSTRACT

The present invention relates to a loudspeaker (1). The loudspeaker (1) includes: a U-yoke for holding a magnet having a base (12) with an upstanding side (14) around the perimeter of the base (12); a frame (20) having a ring (22) around the U-yoke, the ring having a U-shaped cross-section orientated with a base (24) of the U abutting the side (12) of the U-yoke; a dome shaped diaphragm (40) connected to the frame (20) by a resilient member (30) around the dome (40), the resilient member (30) and the dome (40) being suspended from the frame (20); a first cavity (70) defined by the dome (40), resilient member (30), frame (20) and U-yoke; an external wall (80) around the circumference of the frame (20), the external wall (80) sealing a top of the U-shaped cross-section of the ring (22) forming a second cavity (100) between the external wall (80) and the ring (22); a port (110) in the frame (20) between the first cavity (70) and second cavity (100), wherein the first cavity (70) and second cavity (100) and the port (110) form a Helmholtz resonator system. The shape of the frame (20) in combination with the external wall (80) allows a Helmholtz resonator system to be established within the existing footprint of the loudspeaker.

20 Claims, 13 Drawing Sheets

(51) Int. Cl.

| | |
|---|---|
| ***H04R 31/00*** | (2006.01) |
| ***H04R 3/08*** | (2006.01) |
| ***H04R 7/12*** | (2006.01) |
| ***H04R 9/04*** | (2006.01) |
| *H04R 1/00* | (2006.01) |
| *H04R 9/02* | (2006.01) |

(52) U.S. Cl.
CPC ..... *H04R 3/08* (2013.01); *H04R 7/127* (2013.01); *H04R 9/041* (2013.01); *H04R 31/00* (2013.01); *H04R 1/288* (2013.01); *H04R 1/2823* (2013.01); *H04R 1/2846* (2013.01); *H04R 9/022* (2013.01); *H04R 9/027* (2013.01)

(56) References Cited

U.S. PATENT DOCUMENTS

| | | | | |
|---|---|---|---|---|
| 8,073,184 | B2 * | 12/2011 | Horigome | H04R 1/06 381/386 |
| 2005/0078849 | A1 * | 4/2005 | Funahashi | H04R 31/006 381/412 |
| 2010/0067714 | A1 | 3/2010 | Cheng | |
| 2010/0246881 | A1 * | 9/2010 | Jeong | H04M 1/035 381/387 |

* cited by examiner

LOUDSPEAKER WITH A HELMHOLTZ RESONATOR

The present invention relates to loudspeakers, in particular relating to loudspeakers with Helmholtz resonators.

Loudspeakers are used to generate sound over a large frequency range. It is often the case that different speakers are used to generate sound for different parts of an overall frequency spectrum over which sound is to be generated. This is because different parts of the frequency spectrum over which sound is to be generated impose different requirements on the loudspeaker. As such, to get optimum sound quality, different speakers with different configurations are used.

The frequency spectrum can be split up into low, medium and high frequency ranges commonly based on the frequency range audibly to humans. There are a number of situations in which there are greater benefits in using a loudspeaker capable of covering the whole or a substantial part of the frequency spectrum than using a loudspeaker for each frequency range. For example, it is known to use so called full-range loudspeakers in headphones where the most pressing objective is compactness.

Loudspeakers commonly known as tweeters are usually used to serve high frequency ranges and can also be used for medium frequency ranges. Tweeters commonly have a cone diaphragm or a dome diaphragm with which sound is generated.

The use of a cone diaphragm or a dome diaphragm may affect the choice of magnetic system around which the loudspeaker is built. Loudspeakers are commonly built using one of two magnetic systems, a T-yoke magnetic system and a U-yoke system. These are well known systems used to produce loudspeakers. Either magnetic system can be built using either diaphragm type depending on what requirements the loudspeaker needs to meet.

To produce optimum sound quality, the response of a loudspeaker to a particular frequency, the frequency response, should be constant across the frequency range of the loudspeaker. However, loudspeakers have a fundamental resonance caused by the mutual interaction between the weight of the moving parts and the stiffness of the suspension, which consists of the mechanical suspension of the acoustic components of the loudspeaker and the acoustical suspension of the air enclosed behind the diaphragm. The fundamental resonance causes a peak in the frequency response of the loudspeaker when the damping of the fundamental resonance is insufficient. Dome tweeters commonly have a high fundamental resonance frequency because they are usually not acoustically connected to a housing that provides an air volume to lower the resonance frequency. This causes the fundamental resonance to fall within the frequency range of the loudspeaker causing degradation in the sound quality as the frequency response of the loudspeaker is not constant across its range.

Damping in a loudspeaker reduces the height of the resonance peak. However, in dome tweeters the damping is often insufficient as the strength of the magnetic system driving the loudspeaker is too small to provide enough damping to smooth the frequency response.

To increase the amount of damping in a dome tweeter, ferrofluid is commonly added into the air gap of the magnet system in which the voice coil is located. However, the damping effect of the ferrofluid is subject to high variation as a function of temperature. This results in temperature dependent changes in the frequency response of the loudspeaker.

It is known to link a Helmholtz resonator system to a loudspeaker as a form of damping. However, it is commonly known that this requires the loudspeaker to be built into or connected to a housing in order to form a cavity for the necessary air volumes required to set up a Helmholtz resonator system. This is unsuitable for tweeters as they are not usually connected to a housing, and the housing is often too large for the space in which the tweeter is required to fit.

At its most general, there is provided a dome loudspeaker with a U-yoke magnetic system with a Helmholtz resonator system built within the existing footprint of the loudspeaker. This is produced by using a wall of the loudspeaker as a wall of a cavity and having an adapted frame that allows a cavity to be formed around the magnetic system of the loudspeaker with a communication to another cavity within the existing footprint of the loudspeaker.

According to the present invention, there may be provided a loudspeaker, including: a U-yoke for holding a magnet having a base with an upstanding side around the perimeter of the base; a frame having a ring around the U-yoke, the ring having a U-shaped cross-section orientated with a base of the U abutting the side of the U-yoke; a diaphragm connected to the frame by a resilient member around the diaphragm, the resilient member and the diaphragm being suspended from the frame; a first cavity defined by the diaphragm, resilient member, frame and U-yoke; a wall around the circumference of the frame, the wall sealing a top of the U-shaped cross-section of the ring forming a second cavity between the wall and the ring; a port in the frame between the first and second cavity, wherein the first and second cavities and the port form a Helmholtz resonator system.

Coupling the space inside the loudspeaker between the dome, resilient member and the frame and U-yoke with a space formed around the U-yoke within the frame allows for a compact loudspeaker to be produced. This is because the ring-shaped volume around the U-yoke is used as a second cavity. This does not increase the overall height or diameter of the loudspeaker but enables a Helmholtz resonator system to be integrated into a loudspeaker with a U-yoke configuration.

In addition to this the present invention allows a Helmholtz resonator system to be integrated into the loudspeaker, whilst maintaining a low cost as no additional components are required. Also, the manufacturing process is not further complicated.

The configuration of the loudspeaker components causes only a small amount of extra material to be required. The U shaped ring may also be produced by low cost injection moulding because the U-shape is open to the outside.

The loudspeaker may have walls to the cavities made of plastic instead of metal. This means the loudspeaker of the present invention has little additional mass over a conventional loudspeaker.

The Helmholtz resonator system may be tuned to 0.5 to 4 times the fundamental resonance frequency of the loudspeaker. This has the advantage that a peak in the frequency response at the fundamental resonance frequency can be reduced thereby improving the quality of the sound produced by the loudspeaker of the present invention. The Helmholtz resonator system provides a constant response with respect to temperature, thus once the Helmholtz resonator system is tuned to a particular frequency, the effect of the Helmholtz resonator at that frequency will be constant to across a range of temperatures. This allows the effect on the response of the loudspeaker to be constant if the loudspeaker heats up during use due to a raised temperature in the environment around the loudspeaker or due to energy dissipation in the voice coil of the loudspeaker.

The Helmholtz resonator system may be tuned by dimensioning one or more of: the volumes of the first cavity and the second cavity, and the cross-sectional area and length of the port. The tuning frequency of the Helmholtz resonator depends on the air mass inside the port and the sum of the stiffness's of the two air volumes of the two cavities. Because the stiffness of an air volume depends on the cross-sectional area of the opening through which it is pressurised, in this case the cross-sectional area of the port, both the cross-sectional area and length of the port must be taken into account, and not only the volume of the port, which defines the air mass inside the port. For example, decreasing the volume of one or both cavities will increase the tuning frequency because the sum of the stiffness's increases. Alternatively, the length of the port could be decreased, or the cross-sectional area of the port could be increased in order to increase the tuning frequency. By changing the cross-sectional area and length of the port, the volume of the port can be kept constant whilst allowing the Helmholtz resonator system to be tuned.

The Helmholtz resonator system may be tuned to within 1.5 to 2 times the fundamental resonance frequency of the loudspeaker. This leads to an improved effect on the peak in the fundamental resonance at the fundamental resonance frequency that is caused by tuning the Helmholtz resonator system to 0.5 to 4 times the fundamental resonance frequency of the loudspeaker.

The diaphragm may be a dome shaped diaphragm. This is an alternative to a cone shaped diaphragm. Having a dome shaped diaphragm has the advantage that the point of suspension of the diaphragm from the frame can be at the same level as the connection to the drive system of the loudspeaker.

The Helmholtz resonator system may be a damped Helmholtz resonator system. This smoothes the frequency response of the loudspeaker by dissipating energy from air vibrating in the system. This has the advantage of further reducing a peak at the fundamental resonance of the loudspeaker when the Helmholtz resonator system is tuned to a frequency within one of the specified ranges of the fundamental resonance frequency of the loudspeaker.

The damping material may be located in the second cavity and/or the first cavity and/or the port in the frame between the cavities. This allows a variety of different materials to be used for the damping material and to the shape and size of the damping material to be chosen according to the characteristics required of the damping and of the damping material. The damping material may, for example, be open cell foam, fibrous material or fabric.

The port may be sized to induce air flow losses in the port. This may be achieved by reducing the cross-sectional area of the port in order to increase the flow velocity of air in the port. This increases friction between the air layers and thus provokes energy loss in the form of dissipation. Inducing air flow loss in the port causes damping in the Helmholtz resonator system. This can be done in addition to or instead of other damping in the Helmholtz resonator system. This allows less damping material to be used, and means the degree of damping can be extended beyond that available when just using damping material. The length of the port can be selected without substantially affecting the air flow losses in the port as this has a negligible influence on the flow velocity of the air compared to the size of the cross-sectional area of the port.

The frame of the loudspeaker may be made of UV-transparent plastic. This enables UV hardening glue to be used to hold the components of the loudspeaker together. This means that the connections between the components of the loudspeaker joined by UV hardening glue are instantly hardened on exposure of the UV hardening glue to UV light. In addition to this no drying buffer is needed in the assembly process as is required when conventional adhesives are used. This therefore reduces the complexity of the assembly process.

There may be a venting hole between the Helmholtz resonator system and the exterior of the loudspeaker. This allows for atmospheric pressure equalization between the air in the cavities of the loudspeaker and the atmosphere outside the loudspeaker. If the loudspeaker assembly were completely airtight, then the dome and attached voice coil will be pushed outwards or inwards depending on the static air pressure difference. This pressure difference can be due to changing atmospheric pressure, or, if the loudspeaker is in use, due to the air inside the loudspeaker expanding due to heating of the air. The risk of changes in pressure damaging the loudspeaker or stopping it from functioning are reduced by the having a venting hole. The venting hole may work as a Helmholtz resonator in combination with one or both of the cavities of the Helmholtz resonator system. Preferably, the venting hole is tuned to a frequency lower than the working range of the loudspeaker to prevent it from modifying the frequency response in the working range.

There may be a venting hole between the first cavity and the exterior of the loudspeaker. Alternatively, there may be a venting hole between the second cavity and the exterior of the loudspeaker.

There may be a plurality of venting holes. This allows venting holes to be located at different positions on the loudspeaker. The plurality of venting holes may be between the first cavity and the exterior of the loudspeaker or may be between the second cavity and the exterior of the loudspeaker. Alternatively, there may be a venting hole between the first cavity and the exterior of the loudspeaker and a venting hole between the second cavity and the exterior of the loudspeaker.

The loudspeaker may be mounted on a body, the mounted loudspeaker having a first venting hole and a second venting hole, wherein in use the first venting hole is higher than the second venting hole such that air is drawn through the loudspeaker due to the Chimney Effect. This has the advantage that the loudspeaker is cooled by the air flow allowing an increase in the power handling ability of the loudspeaker. In use, power is dissipated by the voice coil that is turned into heat that is removed by the air flow through the loudspeaker. The body to which the loudspeaker is mounted may, for example be a housing, such as a loudspeaker housing, or a surface, such as, a car interior, for example on a trim panel or the like. If the loudspeaker is mounted on a trim panel, the loudspeaker may not need to have a loudspeaker housing.

The loudspeaker may have a plurality of first venting holes and/or a plurality of second venting holes. Air can pass out of and/or be drawn into the loudspeaker through multiple holes. This increases airflow through the loudspeaker thereby increasing the cooling effect of the airflow.

The loudspeaker may have a lead wire from the loudspeaker voice coil electrically connected to an end of a conductive tag in the first cavity. The conductive tag may have an opposing end at the exterior of the loudspeaker.

Having a lead wire connected to a conductive tag inside the first cavity has the advantage that the length of the lead wire is short as it is only extends from the voice coil to the conductive tag. This has an advantage over conventional lead wires that extend over a larger distance as reducing the length of the lead wire increases the speaker sensitivity by reducing the electrical resistance and the moving mass of the lead wire which moves with the voice coil as it drives the dome diaphragm. This use of the conductive tags is enabled by the shape of the frame that enables the conductive tags to be held in position by the frame. More particularly, the use of conductive tags is enabled by the frame being located around the U-yoke to hold the tag in position. In combination with the resilient member being located above the frame, and the resilient member being wide, the frame has a diameter that allows space for a solder contact to be created between the frame and the resilient member. For example, the resilient member may have a width between its internal edge connected to the diaphragm and its external edge connected to the frame of 3 mm to 10 mm, the surface of the frame from which the conductive tag protrudes into the first cavity will therefore have a comparable dimension of about 3 mm to 10 mm. This provides sufficient space for a lead wire to be connected to a conductive tag by a solder contact.

The use of conductive tags to connect the lead wires inside the first cavity protects the lead wires from corrosion because they are contained within the body of the loudspeaker. In addition to this, no sealing of the lead wire is required. In common tweeter designs, the lead wires are trailed from the voice coil to the exterior of the loudspeaker thus leaving the enclosed air cavity. The lead wires are then electrically connected to tags at the outside of the enclosed cavity. The pass-through of the lead wires form the enclosed cavity to the outside air is then sealed with, for example, glue to prevent air blow noises through the pass-through caused by an air leak in the enclosed cavity. By putting the electrical contact of the lead wire inside the first cavity, no sealing of the lead wire is required.

The conductive tag may be orientated through the frame from one side of the U-shaped cross-section of the ring to the other. This allows electrical connection to be made with the voice coil from a base of the loudspeaker which protects the electrical connections and does not extend the footprint of the loudspeaker.

The conductive tag may be a metal conductive tag.

The loudspeaker may have a filter capacitor for reducing the bandwidth of the loudspeaker. The filter capacitor may be located in a holder in the frame in part of the ring, the holder being acoustically isolated from the Helmholtz resonator system. A long axis of the filter capacitor may be orientated out of a plane of the ring causing the capacitor to protrude from a back of the loudspeaker, the back of the loudspeaker being distal to the dome diaphragm.

The position of the filter capacitor allows the loudspeaker to be a minimal height from the back for the loudspeaker to a peak of the dome as the filter capacitor uses a part of the space by the ring thus being offset from the magnetic system within the U-yoke.

The loudspeaker may have a cooling device connected to the U-yoke, the cooling device having a larger surface area exposed to the exterior of the speaker than the U-yoke. This causes heat to be lead away from the magnetic system and to be dissipated to the outside. An advantage of this is that the surface in contact with the air is increased compared to the surface of the U-yoke alone. This increases the power handling of the loudspeaker.

The cooling device may be a plate attached to the base of the U-yoke. The plate may bent or ribbed. This further increases the contact surface of the plate with the air.

The loudspeaker may have a front cover for protecting the dome, the front cover being located over the dome and may be connected to the wall of the loudspeaker. The front plate has the advantage that it protects the mountings of the resilient member and dome from fingers. As a separate advantage, the wall around the loudspeaker allows a wall of the second cavity to be formed. As this wall is a separate part to the ring, it enables the ring to be moulded at low cost as it has an open side.

According to the present invention, there may be provided a method of manufacturing a loudspeaker, including the steps: mounting a frame on a centring jig, the frame having a ring with a U-shaped cross-section orientated with a base of the U at an interior edge of the ring and a top of the U at an exterior edge of the ring; putting a coil on the centring jig; putting adhesive on an edge of a diaphragm and an outer edge of a resilient member around the diaphragm; placing the edge of the diaphragm on the coil and the resilient member on the frame; curing the adhesive; mounting a wall around the exterior edge of the ring; mounting a U-yoke magnetic system within the interior edge of the ring, the U-yoke magnetic system having a base with an upstanding side around the perimeter of the base, the upstanding side abutting the interior edge of the ring; applying adhesive between the wall and the ring, and between the ring and the U-yoke magnetic system; and curing the adhesive, wherein a first cavity is formed by the diaphragm, resilient member, frame and U-yoke, and there is a second cavity between the wall and the frame, and wherein there is a port in the frame between the first and second cavities, the first and second cavities and the port forming a Helmholtz resonator system.

The frame may be made of UV-transparent plastic, wherein the adhesive may be UV hardening glue that is cured by shining UV light through the UV transparent plastics over the UV hardening glue. The use of UV hardening glue means the connections made using the UV hardening glue may be instantly hardened by shining UV light over the connections. In addition to this, no drying buffer is needed.

The use of UV hardening glue has the further advantage that the diaphragm to coil and resilient member to frame connections may be made in one process step. The ring to front cover connection and ring to U-yoke magnetic system connection may also be made in one process step.

An embodiment of the invention is described in detail below with reference to the accompanying figures, in which.

Figure 1:
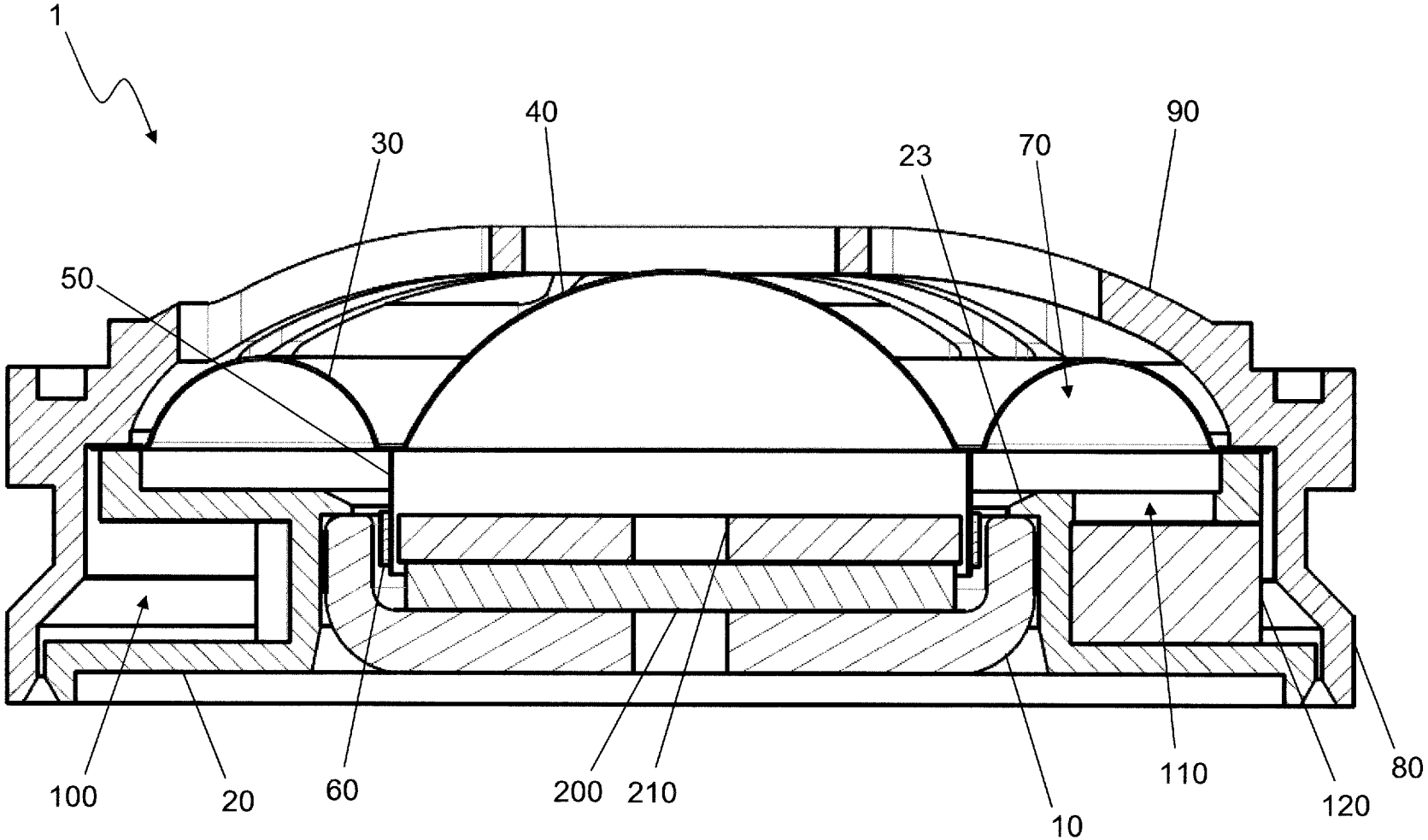
FIG. 1 shows a sectional view of an embodiment of the invention.

The loudspeaker 1 is a dome loudspeaker that can be used as a tweeter or as a full-range loudspeaker. The loudspeaker 1 is built around a U-yoke magnetic system. As shown in FIG. 1, the loudspeaker 1 has a U shaped holder 10 for the disc magnet that is known as a U-yoke. The U shaped holder 10 has a base on which the magnet 200 sits. The base is relatively wide with respect to the side of the U shaped holder 10 that is upstanding from the edge of the base. The U-yoke 10 forms a central part of the loudspeaker 1 around which the other parts are located.

The U-yoke 10 with the magnet 200 and a washer 210 placed on top of the magnet 200 form the U-yoke magnetic system. The U-yoke 10 and washer 210 are both made of ferromagnetic material such as, for example, steel. The placement of the magnet 200 on the base 12 of the U-yoke 10 and the placement of the washer 210 on top of the magnet 200 direct a static magnetic field generated by the magnet 200 into the air gap between the magnet 200 and the side 14 of U-yoke 10. This ideally creates a uniform field that the voice coil can pass through when the loudspeaker is being operated. The voice coil is passed through the magnetic field when a current is passed through the voice coil. The voice coil is allowed to move through the magnetic field as it is located in a gap between the edges of the magnet 200 and the washer 210 and the side 14 of the U-yoke 10.

The following description relates to an embodiment of the loudspeaker 1 shown in the figures. Features of the loudspeaker 1 are identified by reference numerals. The reference numerals used below are each identified in the figures. If a reference numeral is not shown in the figure being referred to, it is shown in one of the other figures.

FIG. 1 shows a frame 20 located around the U-yoke 10. A part of the frame 20 is formed of a ring 22 that has a U shaped cross-section with the base 24 of said U forming an inner side of the ring 22 and an outer side being formed by a peak or top of each side of said U. The inner side of the ring 22 is in contact with the side 14 of the U-yoke 10, and the sides of the ring form an upper side 26 and a lower side 28 separated by the base 24 of the U shaped cross-section. The frame 20 also has a lip 23 that extends from the base 24 of the U shaped ring at an upper side 26 of the ring over a top of the side 14 of the U-yoke 10. The lip 23 allows the U-yoke 10 to be correctly positioned within the ring 22 when the loudspeaker 1 is being constructed.

A resilient member 30 is suspended from the frame 20. The resilient member 30 is supported by a rim 27 that is a projection on the frame 20 around the circumference of the upper side 26 of the ring 22. The resilient member 30 is ring shaped and is connected to a dome diaphragm 40 at the centre of the resilient member 30. The resilient member 30 is flexible to allow the diaphragm 40 to move. The resilient member 30 has a domed cross-section that allows it flex when the diaphragm 40 moves. The resilient member 30 acts to keep the diaphragm 40 centred over the U-yoke magnetic in a similar way to how a spider centres the cone in a cone speaker. Materials that can be used for the resilient member 30 and dome 40 are well known.

The resilient member 30 and the diaphragm 40 can be formed of a single piece of material or of two separate pieces that are joined together. A voice coil former 50 is attached at the connection point between the resilient member 30 and the dome diaphragm 40. The voice coil former 50 is attached to an underside of the dome and extends from the connection point into a gap between the magnet 200 and the sides of the U-yoke 10. The voice coil former 50 has a voice coil 60 wrapped around it at an end portion of the voice coil former 50 in the gap between the U-yoke 10 and the washer 210. There is also an air gap between the circumference of the magnet 200 and the U-yoke 10.

The suspension of the resilient member 30 from the frame causes a first cavity 70 to be formed in the space between the frame 20, resilient member 30, dome 40 and the U-yoke 10. As air is capable of passing from the space between the frame 20 and the resilient member 30 to the space between the U-yoke 10, washer 210 and the dome 40 and between the U-yoke 10 and the magnet 200, this space also forms part of the first cavity 70.

The perimeter of the loudspeaker 1 is defined by an external wall 80 that is attached around the frame 10. The external wall 80 is directly connected to both the upper side 26 and lower side 28 of the ring 22 and extends to a top edge of the frame 10. At the top edge of the frame 10 there is a front cover 90 that is formed as a single piece with the external wall 80. The front cover 90 extends over the resilient member 30 and dome 40 to protect them from damage. There are holes 95 in the front cover to allow the free movement of air through the front cover.

The connection of the external wall 80 to the upper side 26 and lower side 28 of the ring 22 form a second cavity 100 in the space in the U shaped cross-section of the ring 22 between the external wall 80 and the ring 22 by sealing the top of the U-shaped cross-section of the ring.

FIG. 1 shows a port 110 between the first cavity 70 and the second cavity 100. The port is in the upper side 26 of the ring. The port connects the two cavities forming a Helmholtz resonator system as air is allowed to move from one cavity to the other.

The Helmholtz resonator system is preferably tuned to 0.5 to 4 times the fundamental resonance frequency. More preferably, the Helmholtz resonator system is tuned to within 1 to 3 times the fundamental resonance. Even more preferably, the Helmholtz resonator system is tuned to within 1.5 to 2 times the fundamental resonance. Most preferably, Helmholtz resonator system is tuned to 1.8 times the fundamental resonance. The tuning of the Helmholtz resonator is determined by the volumes of the cavities and the cross-sectional area and length of the port. Having a tuned Helmholtz resonator connected to the loudspeaker reduces the peak in the frequency response of the loudspeaker at the fundamental resonance.

The loudspeaker 1 shown in FIG. 1 also has damping material 120 held in the second cavity 100. This further reduces the size of the peak of the frequency response at the fundamental resonance and makes the frequency response smoother. To make the frequency response smoother, the damping material increases the bandwidth of the peak at the fundamental resonance and reduces the height of the peak. This is done by absorbing energy from the air moving within the cavities.

Loudspeakers can be built around a T-yoke magnetic system instead of a U-yoke magnetic system as used in the present invention. However, it is more common to use a T-yoke magnetic system for cone loudspeakers rather than for a dome loudspeaker. A T-yoke takes up more space than a U-yoke as the magnet must have a central hole to allow the voice coil to pass around the central stem of the T-yoke for it to pass through the magnetic field, thus T-yoke loudspeakers are less suited to small environments than U-yoke loudspeakers. For a U-yoke magnet, the central hole is not required as a tablet or disc magnet is held in the centre of the U-yoke with the voice coil passing around the magnet enabling the frame of the loudspeaker to be more compact. The loudspeaker 1 of the present invention allows a compact loudspeaker with a U-yoke magnetic system to be used with an integrated Helmholtz resonator system to allow to smoothing of the frequency response of the loudspeaker without the need to connect the loudspeaker 1 to an external housing and to use the existing footprint of the loudspeaker such that the dimensions of the loudspeaker with the Helmholtz resonator system built into the loudspeaker do not extend beyond the diameter or height of already used by the loudspeaker.

Figure 2:
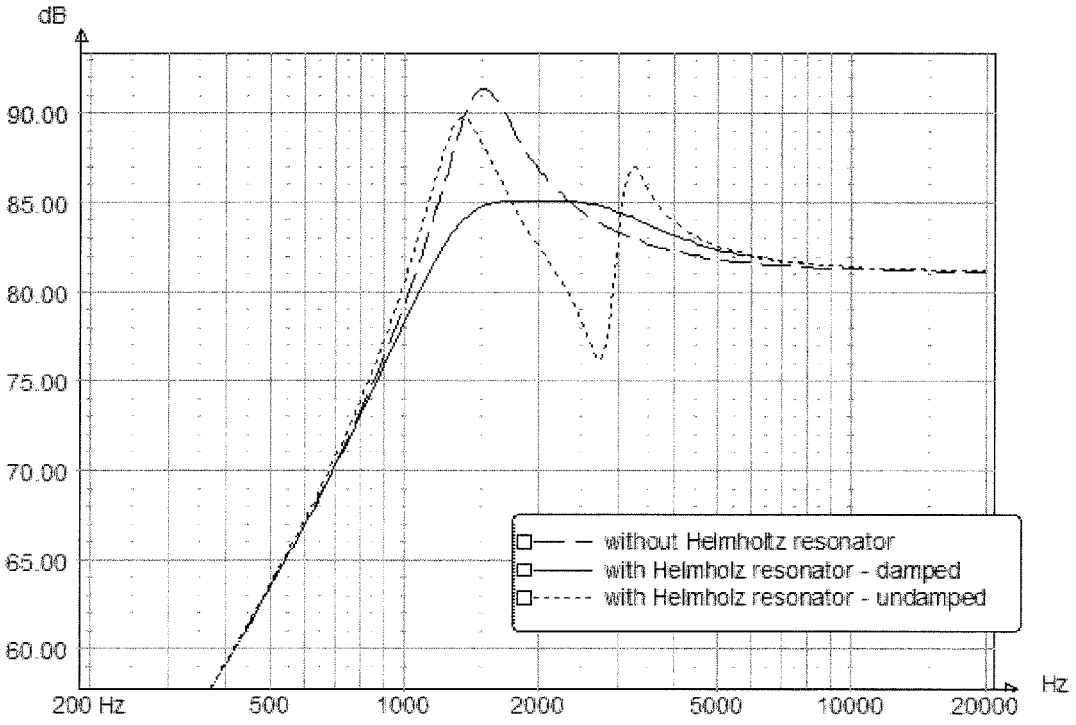
FIG. 2 shows a graph of the frequency response of an embodiment of the invention with and without damping material.

FIG. 2 shows a graph of the frequency response of a loudspeaker according to the invention. The graph shows frequency against sound pressure level expressed in decibels. This shows the response of a loudspeaker at each frequency across the bandwidth of each loudspeaker configuration identified on the graph. To compare the responses, FIG. 2 shows a loudspeaker without a Helmholtz resonator. The curve indicating this rises from a minimum value at a low frequency to a peak which then tapers off to a maximum frequency value. For the same frequency range, an undamped Helmholtz resonator system of the shown in, for example, FIG. 1, has a reduced peak that is shifted to a lower frequency. The peak is followed at a higher frequency by a tough mirroring the peak which is then followed by a second smaller peak at a higher frequency. FIG. 2 also shows the response of a loudspeaker with a Helmholtz resonator system that is damped. This shows a shorter peak than both previous responses. The bandwidth of this peak is larger and has a flat top. This therefore produces a more constant response over the peak bandwidth and over the loudspeaker bandwidth than the undamped Helmholtz resonator system and the loudspeaker without a Helmholtz resonator.

Figure 3:
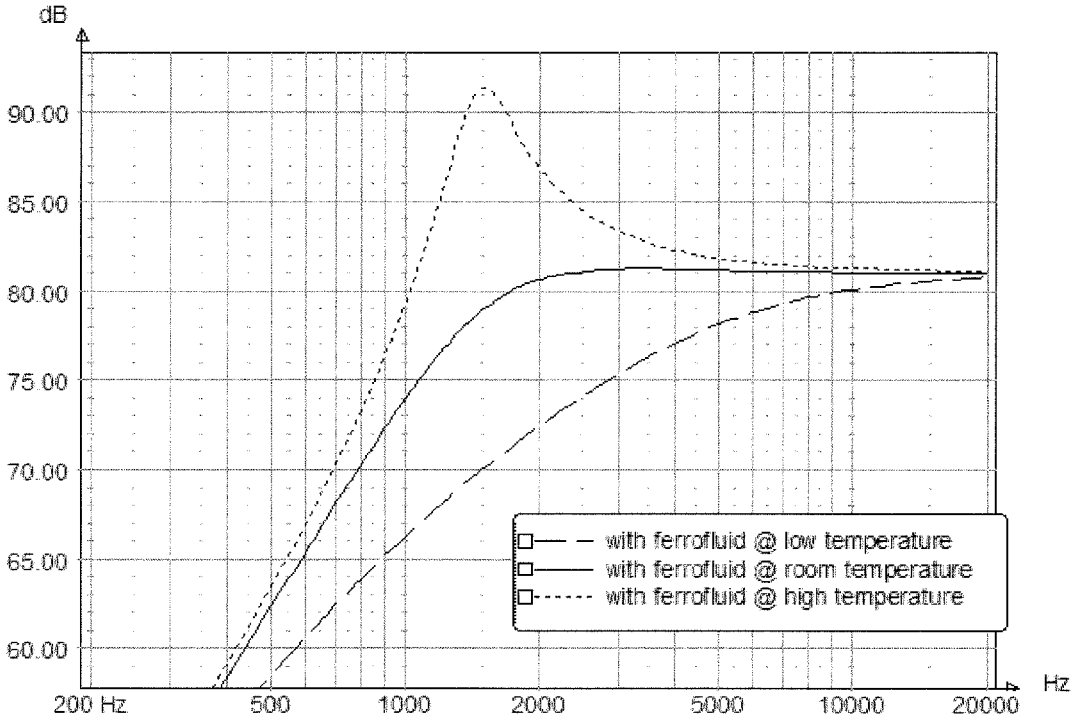
FIG. 3 shows a graph of the frequency response of the prior art change with respect to temperature.

The inventors found that the frequency response of the loudspeaker 1 with a damped and an undamped Helmholtz resonator system is constant with respect to temperature. In contrast, as shown in FIG. 3 which shows a plot of frequency against decibels for a loudspeaker, the frequency response of a loudspeaker containing ferrofluid to mediate the resonance peak changes with temperature. The response changes because the viscosity of the ferrofluid changes with temperature. At low temperature, a loudspeaker containing ferrofluid has a curved response across the frequency range at a reduced level causing a thin sound to be produced by a loudspeaker. At room temperature, the frequency response rises to a plateau at a lower part of the frequency range and then remains approximately constant across the remaining part of the frequency response. At high temperature, the frequency response is the same as a loudspeaker that does not contain a ferrofluid showing that at high temperature, the ferrofluid has little or no effect on the frequency response of a loudspeaker. This causes a harsh sound to be produced by the loudspeaker. Both the harsh sound and thin sound produced are audible by a listener and are undesirable qualities in a loudspeaker. The low temperature curve is the response produced at −20° C., and the high temperature curve is the response produced at +60° C. As is shown by the curves plotted for room temperature and for the high and low temperatures, the frequency response of a loudspeaker with a ferrofluid acting as damping is variable with respect to temperature.

It is preferable that the second cavity 100 is located around the U-yoke magnetic system as shown in FIG. 1. However, it is possible that a second cavity could be located in the same space as a first cavity between the frame 20, U-yoke 10, dome 40 and resilient member 30 with the frame shaped to create a barrier between such cavities. The most suitable configuration for having a first and second cavity in the same space is to have a second cavity in an enclosure around the frame 20 located on the upper side 26 of the ring 22 between the upper side 26 of the ring 22 and the resilient member 30 and maintain a separation between enclosure of the second cavity and the resilient member to act as part of a first cavity. This will lead to an increase in the distance from the dome diaphragm to the magnet. However, distortion of the sound may be caused if the dome diaphragm is suspended at too great a distance from the magnet as this causes the centring of the voice coil of the loudspeaker around the magnet to move during use resulting in rub and buzz audible to a listener.

Figure 4:
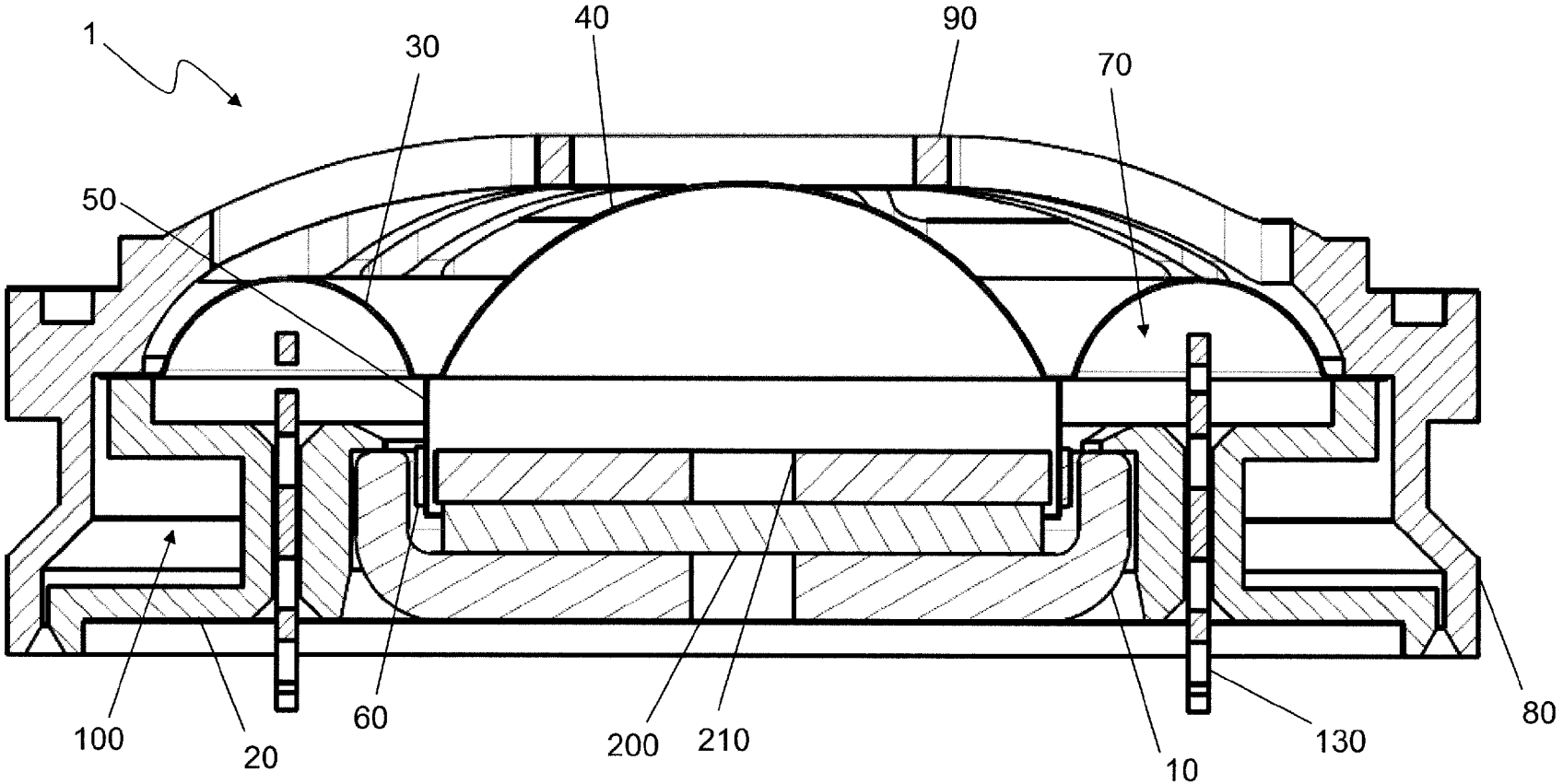
FIG. 4 shows a second section view of an embodiment of the invention.

FIG. 4 shows a sectional view of the loudspeaker 1 with the section taken along a different plane to that of FIG. 1. The sectional view shown in FIG. 4 shows a conductive tag 130 on either side of the U-yoke 10 in diametrically opposite positions on the frame. The conductive tags 130 pass through the ring from one side to the other with an end protruding into the first cavity 70 and an end protruding from the lower side of the ring out of a base of the loudspeaker 1. The end of each conductive tag 130 in the first cavity 70 is electrically connected to a lead wire (not shown) from the voice coil 60. The lead wire and the conductive tag 130 are connected by solder. However, other forms of electrical connection can be used as alternatives, for example by crimping or welding the lead wire to the tag.

The end of each conductive tag 130 exposed at the base of the loudspeaker 1 is shaped to allow a cable to be held. Wire exposed from the cable can then be soldered to the conductive tag 130. The shape is configured to allow a cable to be held in a slot with a circular aperture in which the cable sits and neck that stops the cable from moving laterally with respect to is length as it has a smaller width than the diameter of the circular aperture, which has a comparable diameter to the cable. The neck is between the aperture and the end of the conductive tag 130. The cable is soldered to the conductive tag 130 to establish an electrical connection to the loudspeaker 1 to enable current to be supplied to the voice coil 60.

In the embodiment of the loudspeaker 1 shown in FIG. 4, the conductive tags 130 are each located in a passage in the ring 22. This isolates the conductive tags 130 from the second cavity 100. However, it is not essential that the conductive tags 130 are isolated from the second cavity. Alternatively, the conductive tags can be held between the first cavity 70 and the second cavity 100 and/or between the second cavity 100 and the exterior of the loudspeaker. The passages in the ring 22 for the conductive tags 130 have cooperative dimensions to each conductive tag 130. This ensures a close fit with the conductive tags 130. The conductive tags 130 may have retention hooks (not shown) that engage the frame 20 to hold each conductive tag 130 in place. In addition or as an alternative to the retention hooks, the passage through which each conductive tag 130 is located may have smaller dimensions than the conductive tag located through it. This also allows the each conductive tag 130 to be held in place. An advantage of using this configuration of the conductive tags 130 and ring 22 lies in the fact that there is a long sealing length along the length of each conductive tag held in the passage. This assures a reliable air-tight sealing between the cavities and the outside of the loudspeaker. A leak around the conductive tags 130 would give rise to rub and buzz noises. An alternative configuration of the conductive tags that allows a length of the conductive tags 130 to be sealed within the frame of the loudspeaker 1 would present the same advantages.

To make it easier to connect a lead wire to each of the conductive tags 130, each conductive tag 130 has a hook at the end exposed in the first cavity 70. The hook allows a lead wire to be inserted easily held by a conductive tag 130, while at the same time, it assures the correct height position of the lead wire, separated from the resilient member 30 and the frame 20. If the lead wire touches the resilient member or the frame, this gives rise to a rub and buzz noise.

Figure 5:
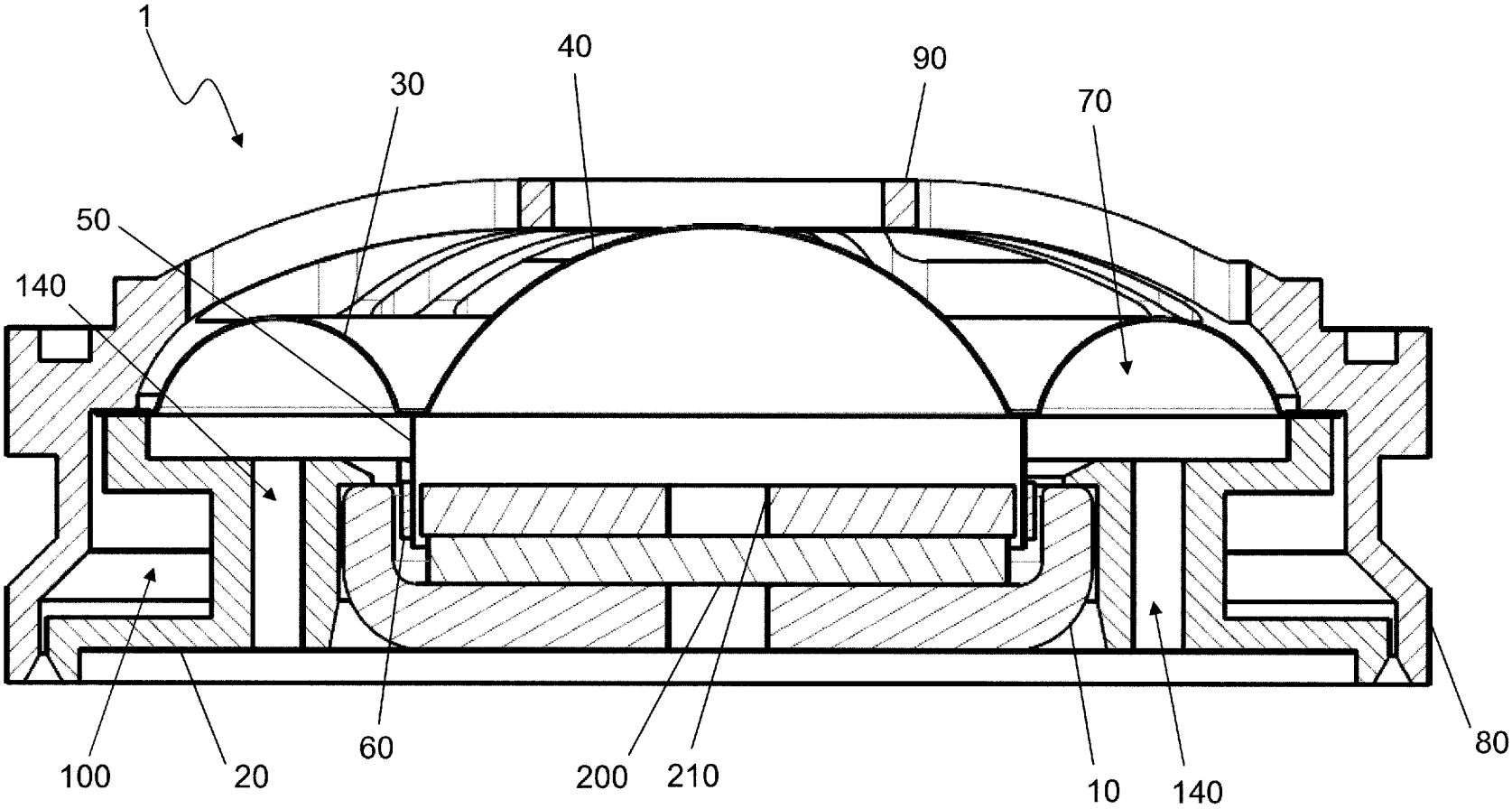
FIG. 5 shows a third section view of an embodiment of the invention.

A second different sectional view of the loudspeaker 1 is shown in FIG. 5. FIG. 5 shows venting holes 140 in the loudspeaker 1. The venting holes 140 in the embodiment of the loudspeaker 1 shown in FIG. 5 are at the base of the loudspeaker 1 in the lower side 28 of the ring 22 and connect through to the upper side 26 of the ring 22 to provide a passage for air from the first cavity 70 to the outside of the loudspeaker 1. The passage is isolated from the second cavity 100. The venting holes 140 are located at diametrically opposite positions in the frame. However, the venting holes 140 can be located in different positions relative to each other.

As an alternative configuration, there may be only one venting hole 140, the venting holes 140 can provide a passage from the exterior of the loudspeaker into the second cavity 100, or there can be a venting hole 140 providing a passage into the first cavity 70 and a venting hole providing a passage into the second cavity 100. The venting holes 140 may also be in the external wall 80 instead of in the base of the loudspeaker 1. If the venting holes 140 are in the external wall 80, the passage of the venting hole may also pass through the frame 10, such as through a rim 27 around the circumference of the upper side 26 of the ring 22.

The venting holes 140 will, in addition to the Helmholtz resonator system, work as Helmholtz resonators in combination with the air volumes in the loudspeaker 1. Due to this, the venting holes are preferably tuned to a frequency lower than the working range of the loudspeaker 1. In this way, the effect on the frequency response of the loudspeaker 1 is small. In this configuration, air blow noises are minimised because the frequencies at which high air flow velocities occur are kept below the working range of the loudspeaker 1.

When the loudspeaker 1 is mounted in the environment in which it is to be operated (for example on a trim panel of a car interior), the loudspeaker can be mounted so that the venting holes 140 are positioned at different vertical positions relative to each other with a venting hole 140 located higher than another venting hole 140. This creates a cooling effect by allowing hot rising air that is heated by energy dissipation in the voice coil 60 to escape through the higher positioned venting hole 140 or higher positioned venting holes 140, thereby drawing cooler air through the lower positioned venting hole 140 or venting holes 140. This is commonly known as the Chimney or Stack Effect. If the loudspeaker 1 is mounted on its side such that a section of the external wall 80 forms the lowest part of the loudspeaker 1, the venting holes 140, as shown in FIG. 5, located between the base of the loudspeaker 1 and the Helmholtz resonator system will cause this effect if the loudspeaker is orientated such that the vertical distance between the lowest point of the loudspeaker 1 and the venting holes 140 is different and if air can flow through the venting holes 140. Alternatively, the venting holes 140 can be located at different positions on the external wall 80 and/or at different relative heights on the external wall 80 between the base of the loudspeaker 1 and the connection of the external wall 80 and the front cover 90. This allows the loudspeaker 1 to be orientated in a different position. For example, a venting hole 140 may be positioned horizontally between the second cavity 100 and the exterior of the loudspeaker 1 through the external wall 80, and a second venting hole 140 may be positioned horizontally between the first cavity 70 and the exterior of the loudspeaker 1 through the external wall 80 and the frame 20 where necessary. With venting holes 140 in this configuration the loudspeaker can be mounted with the dome diaphragm pointing upwards or downwards from a surface, such as, for example, from or within a floor or ceiling.

Figure 6:
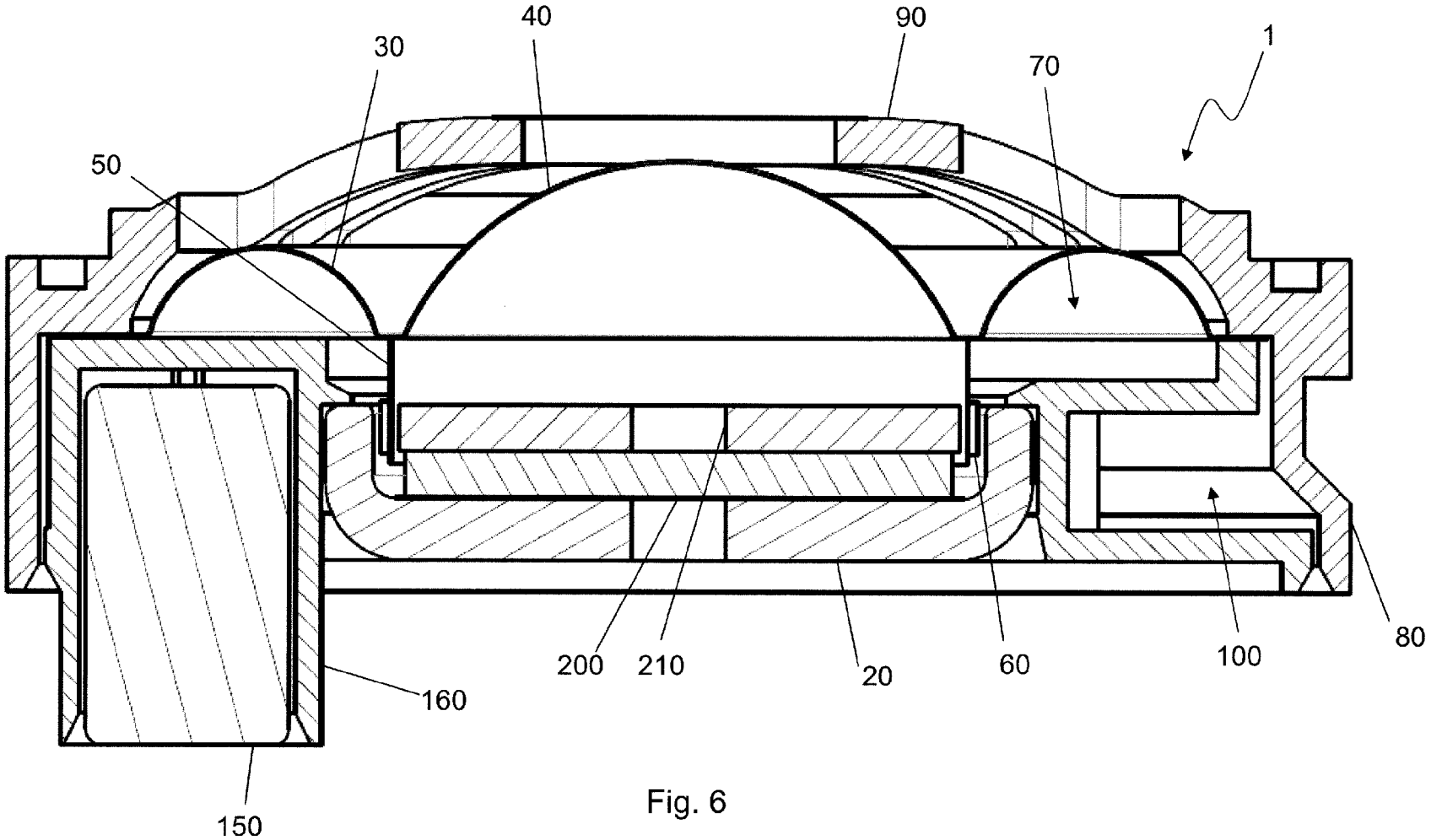
FIG. 6 shows a fourth section view of an embodiment of the invention.
Figure 10:
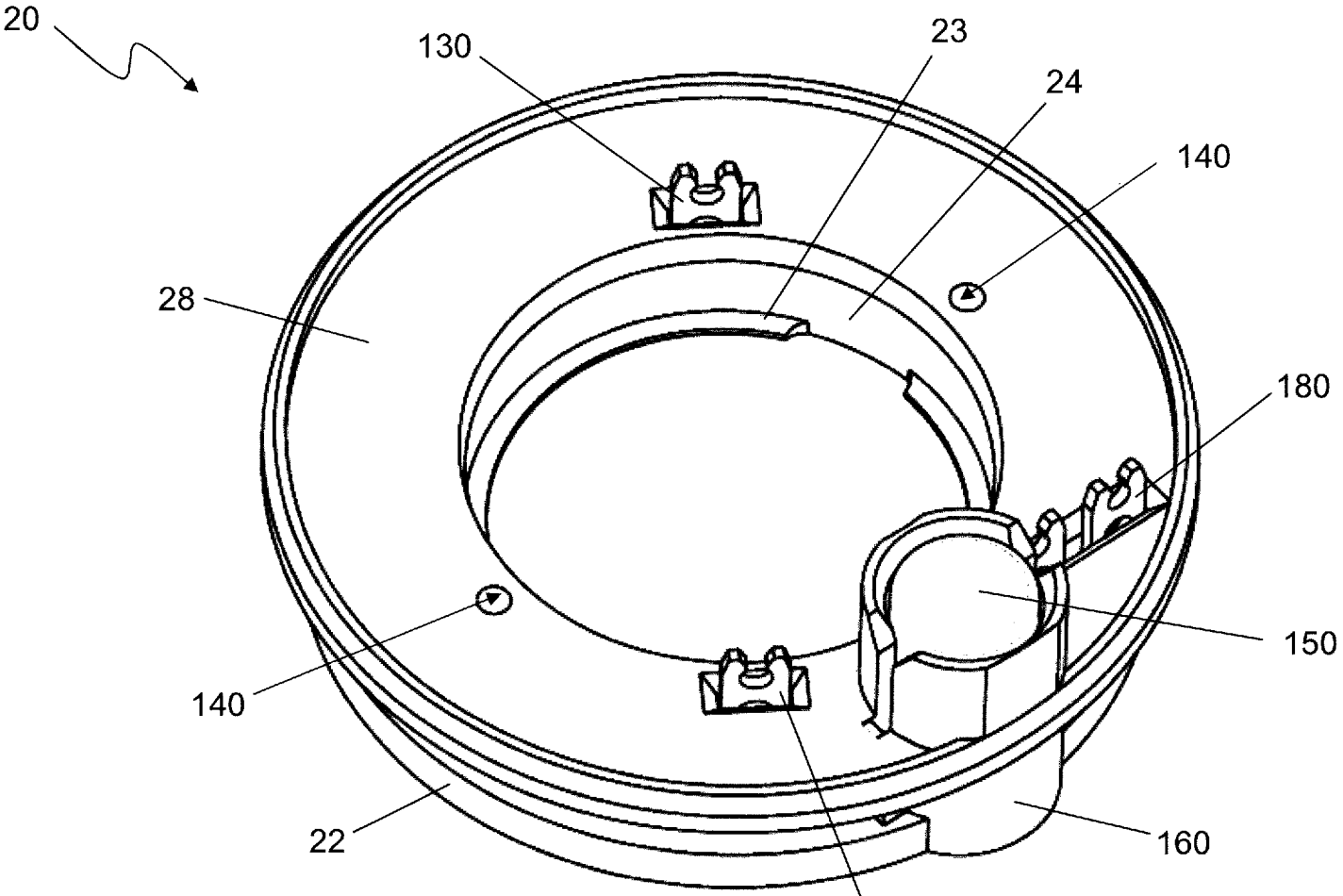
FIG. 10 shows a perspective view of an opposing side of the frame of an embodiment of the invention to that shown in FIG. 9.

FIG. 6 shows a third different sectional view of the loudspeaker 1. This shows a filter capacitor 150 held in a retainer 160. The retainer 160 comprises a recess in the ring 22 segregated from the second cavity 100 that forms a hollow in which the filter capacitor 150 can be placed. The filter capacitor shown in FIG. 6 is cylindrical and has a height that is larger than the width of the base 24 of the ring 22. This causes the filter capacitor to protrude from the lower side 28 of the ring 22 when placed in the retainer 160. To ensure the filter capacitor is protected, the retainer 160 also has projections that extend from the lower side 28 of the ring 22. The projections cover the sides of the filter capacitor 150. The projections are separated by slots that are shown in FIG. 10. The slots allow connection wires to pass to the terminals of the filter capacitor 150 to allow it to be electrically connected to the loudspeaker 1 without needing to pass over the projections. The terminals of the filter capacitor are located within the retainer 160. The filter capacitor 150 can be a different shape or size. If a different shape or size of filter capacitor were used the design of the retainer 160 would be adapted to more closely fit the different dimensions of the filter capacitor 150.

Figure 7:
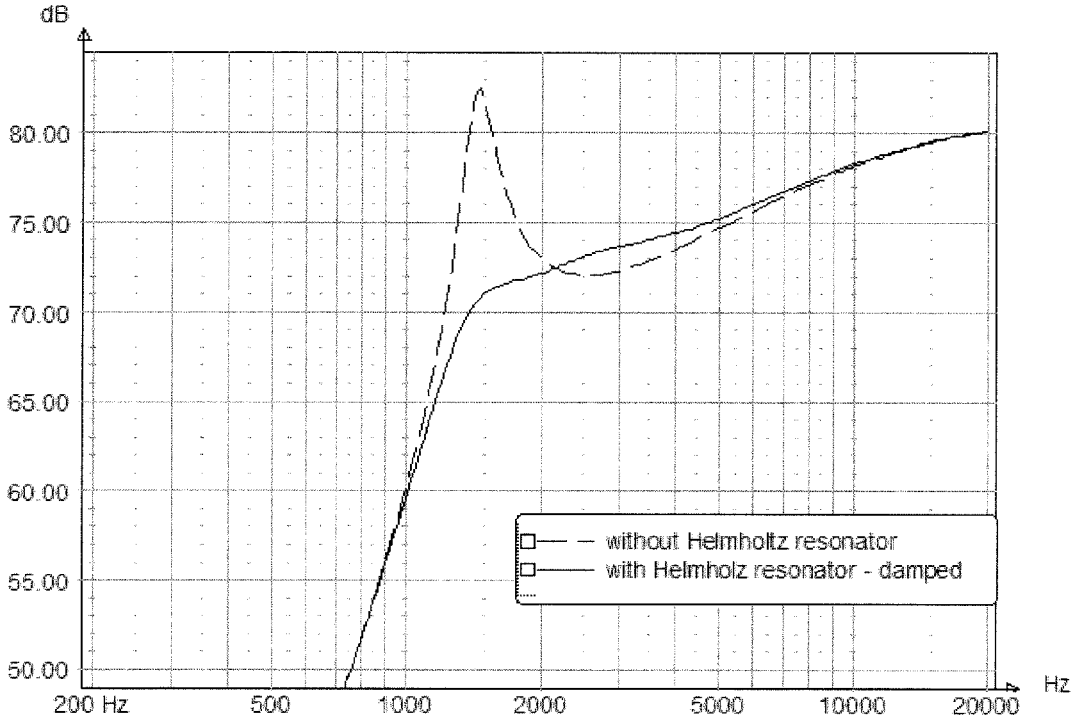
FIG. 7 shows a graph of the frequency response of an embodiment of the invention with and without a filter capacitor connected to the loudspeaker circuitry.
Figure 8:
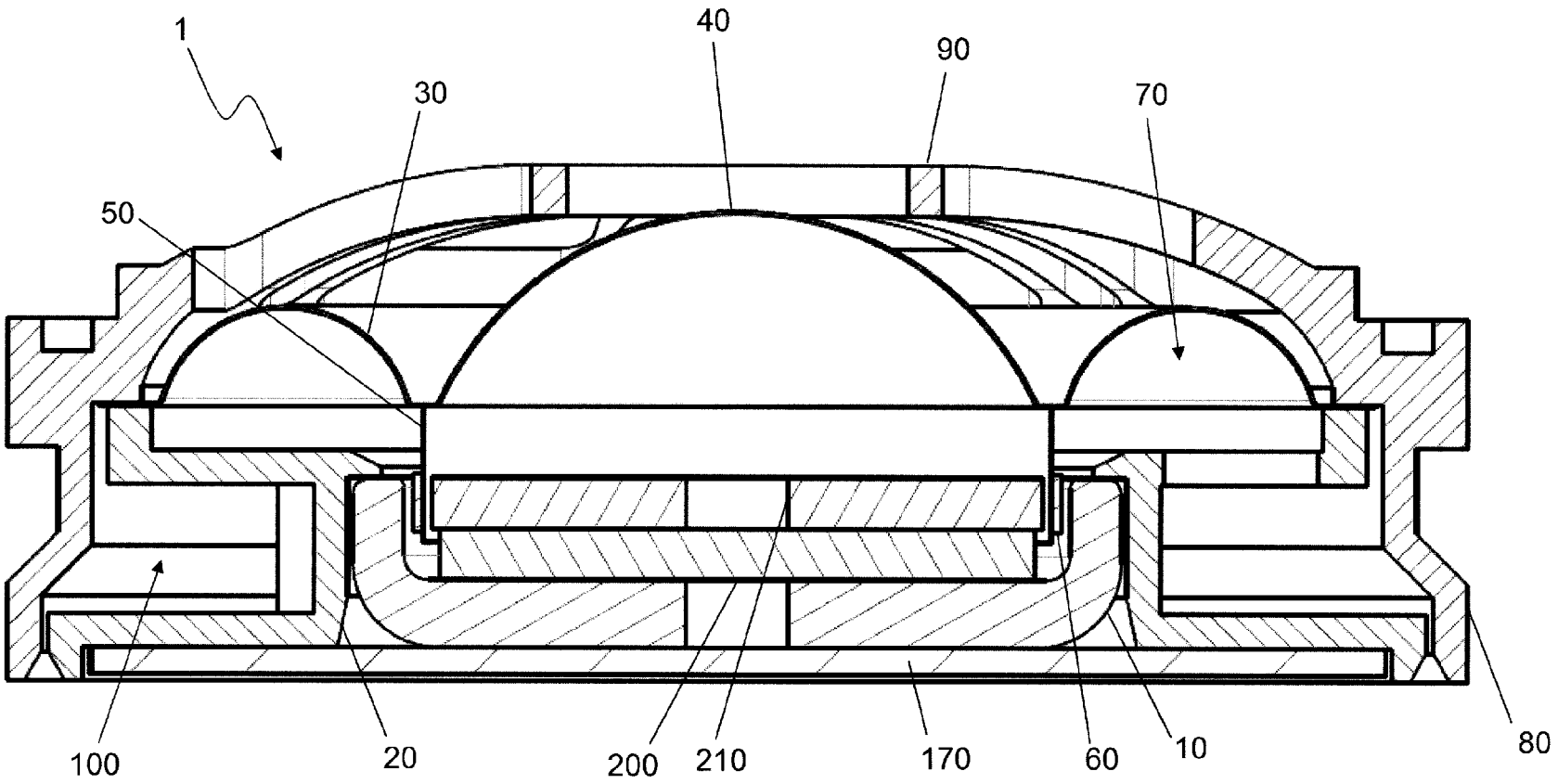
FIG. 8 shows a fifth section view of an embodiment of the invention.
Figure 11:
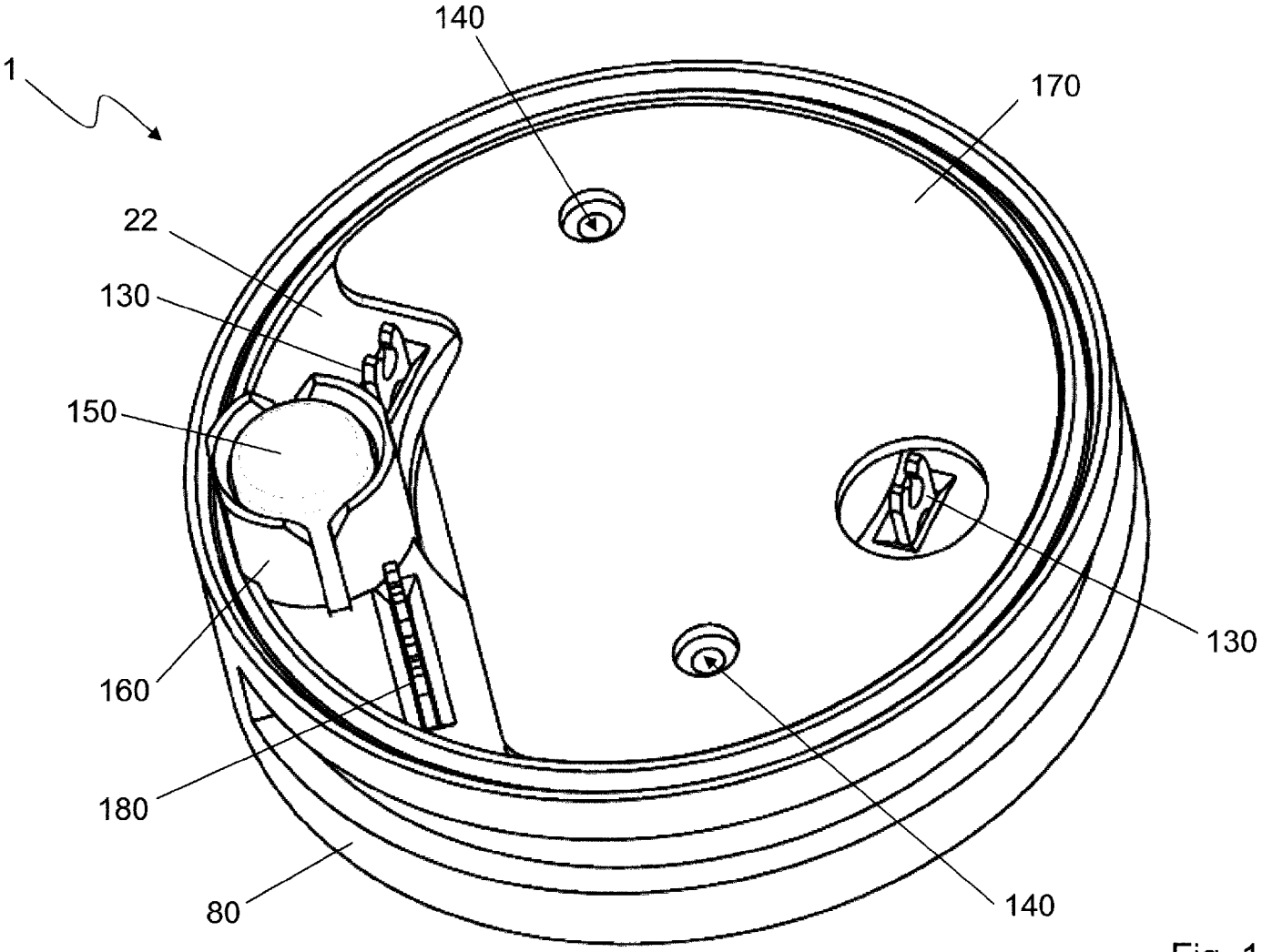
FIG. 11 shows a perspective view of one side of an embodiment of the invention.

As with FIG. 2 and FIG. 3, FIG. 7 shows a plot of frequency against sound pressure level expressed in decibels. FIG. 7 shows the frequency response of the loudspeaker 1 with the filter capacitor 150 connected to the loudspeaker 1. The filter capacitor reduces the bandwidth of the loudspeaker. This can be seen by comparison of the frequency range over which the loudspeaker 1 is shown to work in FIG. 2 and FIG. 7. In combination with the Helmholtz resonator system, the use of the filter capacitor 150 reduces the size of the resonance peak and smoothes the frequency response when the Helmholtz resonator system is damped FIG. 8 shows an embodiment of the loudspeaker 1 with a cooling plate 170 in contact with the base 12 of the U-yoke 10. The cooling plate 170 extends across the back of the loudspeaker to provide a large exposed surface area to allow heat to be drawn from the magnetic system and to dissipate it to the air outside the loudspeaker. The cooling plate 170 may, for example, be made of steel or aluminium. Independently, the cooling plate 170 may have ridges and/or be curved or bent to further increase the surface area in contact with the outside of the loudspeaker 1. FIG. 11 shows that the cooling plate 170 is shaped to extend across as large an area of the back of the loudspeaker 1 as is possible whilst maintaining a design that is easy to manufacture. The cooling plate 170 is not in contact with any of aspects of the loudspeaker 1 that extend from the back of loudspeaker 1 and has holes that allow the venting holes 140 to be exposed to the outside of the loudspeaker 1.

Figure 9:
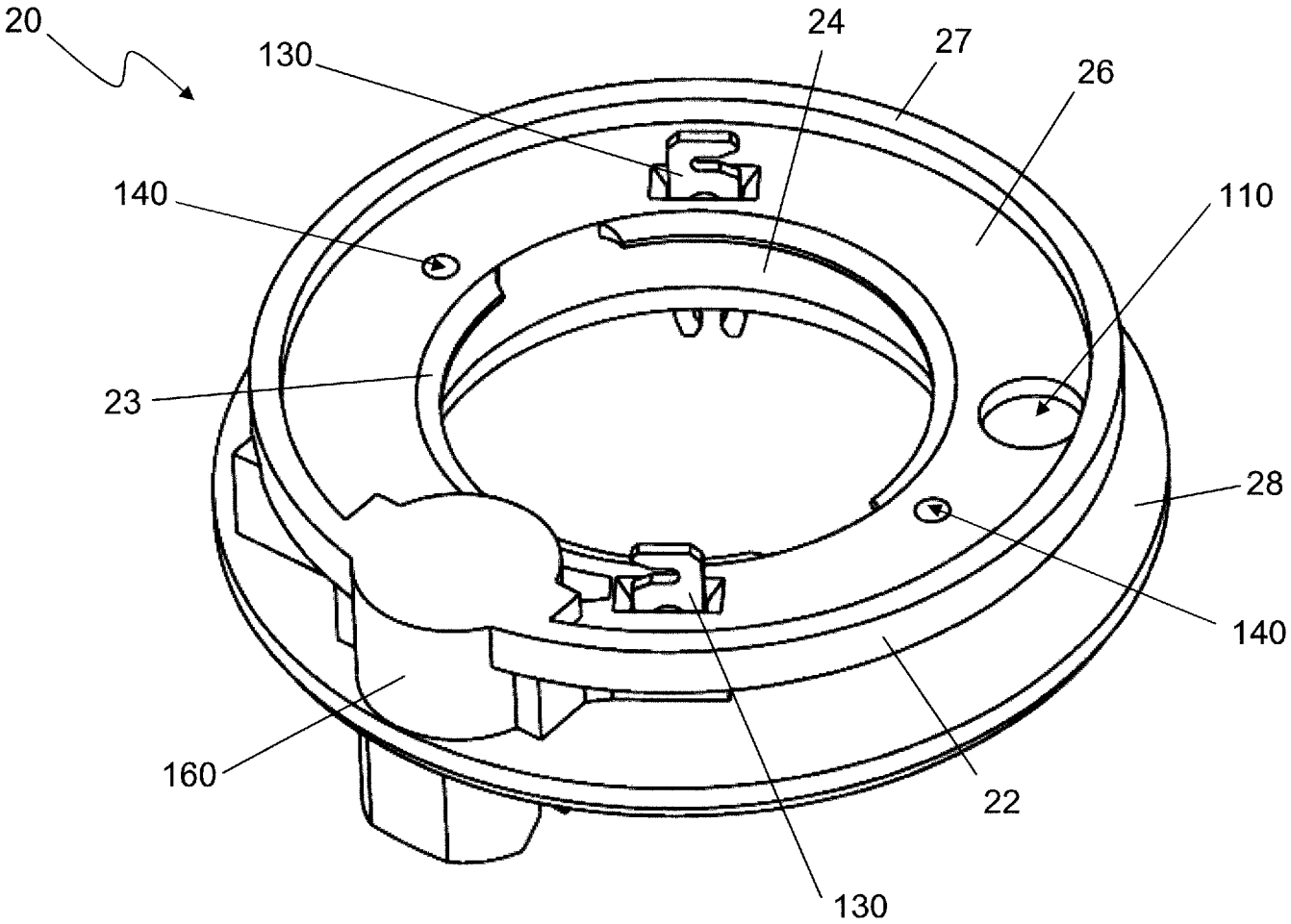
FIG. 9 shows a perspective view of one side of the frame of an embodiment of the invention.

FIG. 9 shows the top side of the frame 20 of the loudspeaker 1 with the conductive tags 130 held in the position in the frame 20. FIG. 9 shows the upper side 26 and the lower side 28 of the ring 22 separated by the base 22 at an interior side of the ring. At the exterior side of the ring, FIG. 9 shows that the lower side 28 extends further from the base 24 than the upper side 26. The lip 23 that is located over the top of the U-yoke 10 when the loudspeaker 1 is complete. The lip 23 is split into two sections and forms a lip 23 protruding inward from the base 24 of the ring 22 from where the upper side 26 of the ring 22 meets the base 24. FIG. 9 also shows the port 110 through the upper side 26 of the ring 22 that allows for communication between the first cavity 70 and the second cavity 100. The venting holes 140 are shown in the upper side 26 of the ring 22. This is the upper part of the venting hole passage that extends to the outside of the loudspeaker 1. The retainer 160 for the filter capacitor 150 is shown at the periphery of the ring 22. The shape of the end of the conductive tags 130 that protrude from the upper side 26 of the frame is shown in FIG. 9. The shape is a hook to allow a lead wire to be located in the eye of the hook and soldered to the conductive tag 130. The upper side 26 of the ring 22 has a rim 27 projected upwards away from the lower side 28 of the ring around the circumference of the upper side 26. The outer edge of the resilient member 30 is located on this rim 27 to allow the resilient member 30 and dome 40 to be at suspended from and attached to the frame 20.

FIG. 10 shows the underside of frame 20 of the loudspeaker. The opposing ends of the passages of the venting holes 140 are shown in diametrically opposed positions on the lower side 28 of the ring 22. The lower side 28 of the ring 22 has a brim around its edge projected away from the upper side 26. This helps to position the cooling plate 170. The end of the conductive tags 130 that are projected out from the lower side 28 of the ring 22 have retention features, such as retention hooks, to allow the easy assembly and soldering of a connection cable.

Figure 12:
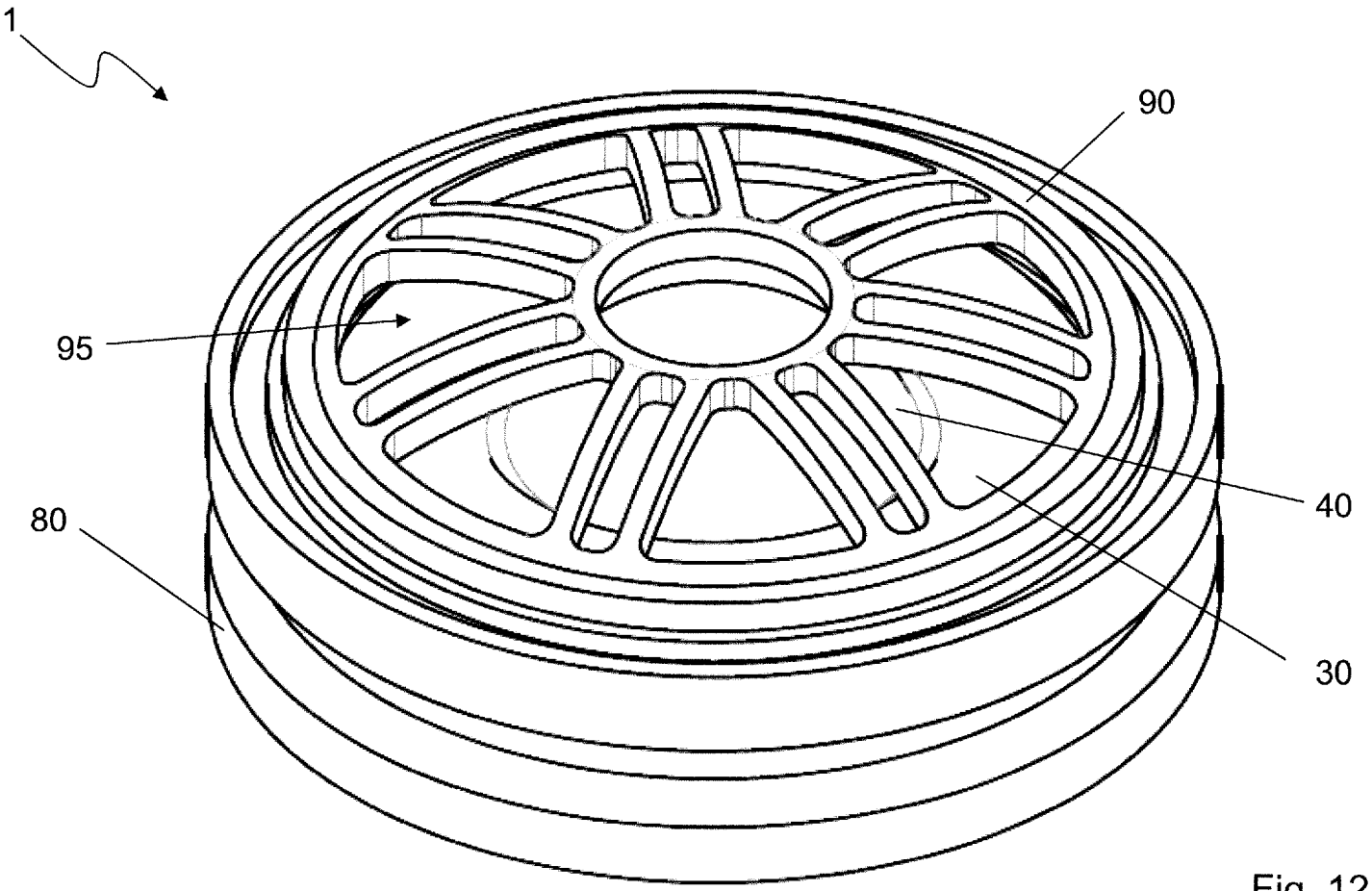
FIG. 12 shows a perspective view of an opposing side of an embodiment of the invention to that shown in FIG. 11.

FIG. 11 shows the underside of the loudspeaker 1. The external wall 80 is shown clipped around the edge of the lower side 28 of the ring 22 with the cooling plate 170 located on the base of the loudspeaker covering the lower side 28 of the ring FIG. 12 shows the top of the loudspeaker 1. This shows the external wall 80 around the frame 20. The front cover 90 extends over the resilient member 30 and the dome diaphragm 40. The front cover has holes 95 that allow air movement through the holes 95 whilst stopping fingers from damaging the dome 40 and the resilient member 30.

Figure 13:
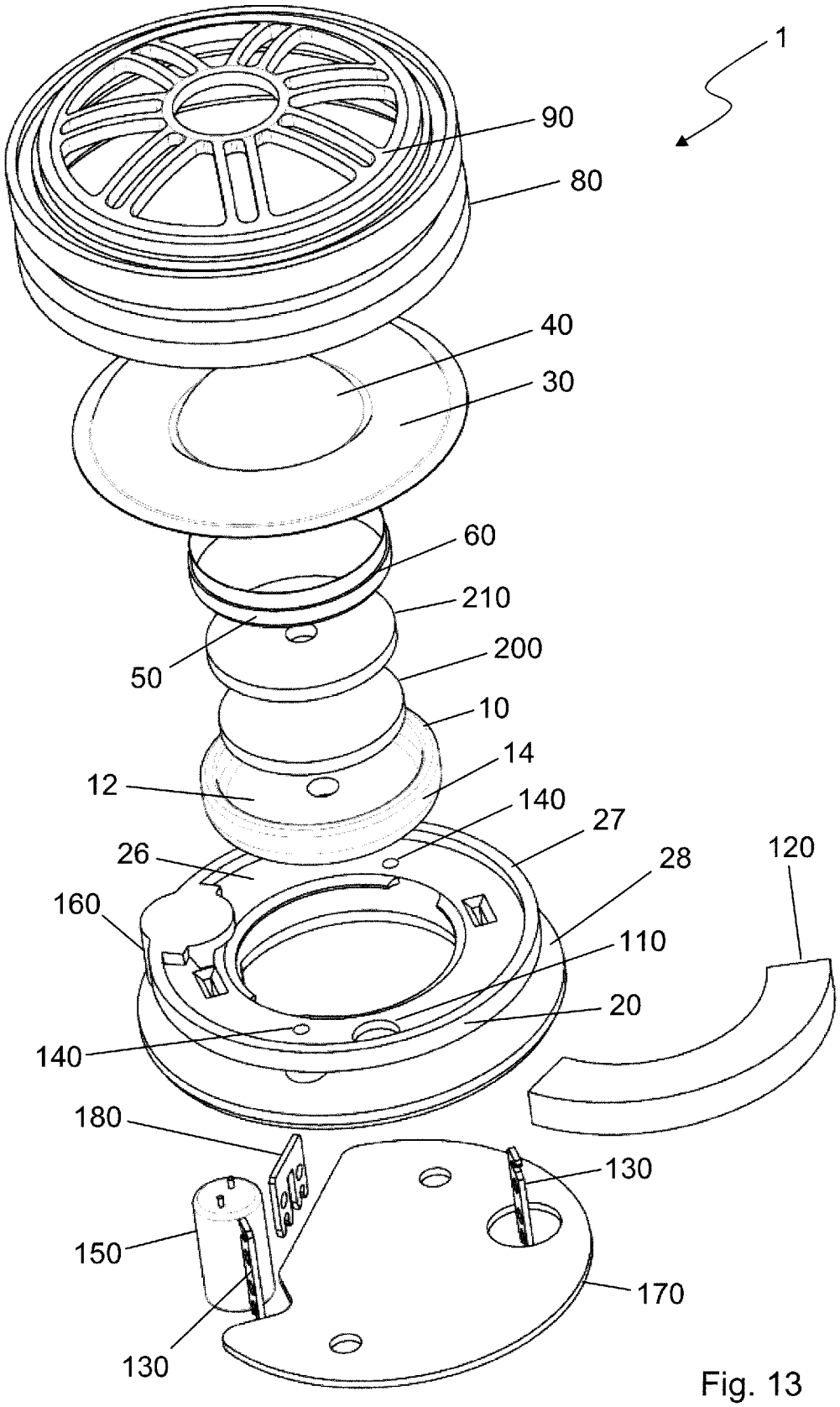
FIG. 13 shows an exploded view of an embodiment of the invention.

FIG. 13 shows and exploded view of the loudspeaker 1. This shows how each of the components of the loudspeaker are orientated with respect to each other. The components of the loudspeaker arranged around a central axis (not shown) passing through a centre point of the front cover 90, resilient member 30, dome 40, voice coil former 50 on which the voice coil 60 is held, washer 210, magnet 200, U-yoke 10 and ring 22. The other components of the loudspeaker are fitter into or against the frame 20 and U-yoke 10 in a slot, opening or recess in their shape. When the loudspeaker 1 is fitted together the damping material 120 slots into the open area between the base 24, upper side 26 and the lower side 28 of the ring. The damping material can be shaped to fit around the various contours of the open area in the ring created by, for example, the passages for the venting holes 140, the retainer 160 for the filter capacitor 170 and the conductive tags 130 or any enclosure that the conductive tags 130 are contained in.

The filter capacitor 150 is electrically connected in series with the voice coil 60. One terminal of the filter capacitor 150 is electrically connected to a connector 180 that is held in the frame in a similar manner to the conductive tags 130, but is isolated from the Helmholtz resonator system. The connector 180 is a U-shaped tag, thereby having two terminals. A terminal of the filter capacitor 150 is electrically connected to a terminal of the connector 180. The other terminal of the connector 180 is electrically connected to a cable that connects the loudspeaker to a driving amplifier when in use. A second terminal of the filter capacitor 150 is electrically connected to one of the conductive tags 130, thereby connecting to the voice coil. The terminal of the other conductive tag 130 at the exposed end of the conductive tag 130 is connected when in use to the amplifier by another connecting cable, thereby connecting the amplifier directly to the voice coil. The electrical connections at the terminals are established by solder joints between to the respective tags, terminals and cables.

The manufacture process of the loudspeaker 1 allows for efficient fabrication thus making mass production feasible. First, the conductive tags 130 are mounted in the ring 22 of the frame 20. The ring 22 is then put on a coil centring jig to hold it in position. A voice coil former 50 with the voice coil 60 wrapped around it is then put on the coil centring jig. Each end of the voice coil 60, known as a lead wire, is then soldered to a conductive tag 130 at an end of the conductive tag 130 that protrudes from an upper side 26 of the ring 22.

Adhesive is then put around the edge of the dome diaphragm 40 at the join between the dome diaphragm 40 and the resilient member 30, and on the outer edge of the resilient member 30. The adhesive is applied to an underside of each of these locations. The underside being a side from which the resilient member 30 and the dome diaphragm 40 protrude away from. Once the adhesive is applied to the diaphragm 40 and the resilient member 30, the dome is then placed on the voice coil 60 and ring 22. The join between the dome 40 and resilient member 30 is placed in contact with the voice coil 60 and the outer edge of the resilient member 30 is placed in contact with the rim 27 projecting from the perimeter of the upper side 26 of the ring 22. The adhesive is then cured to fix the components together.

The frame 20 is made from UV transparent plastic. This enables UV hardening glue to be used for fixing the dome diaphragm 40 and the resilient member 30 to the voice coil 60 and the ring 22. The UV hardening glue is cured by shining UV light through the UV transparent plastic of the frame 20.

If the frame 20 is made of plastic or another material that is not UV transparent, an adhesive such as a 2-component glue, such as acrylic, poly-urethane or epoxy, or a 1-component glue, such as cyanoacrylate, or a solvent or water-based glue may be used as an alternative. However, with a UV hardening glue, no mixing is involved as is required at least from a 2-component glue. This avoids associated process problems of varying mixing ratios and poor mixing. UV hardening glue has a faster curing time than other glues meaning no hardening or drying buffer is required in the production line.

The next step in the manufacturing process of the loudspeaker 1 is to mount front cover 90 and external wall 80 moulded as a single piece around the outside of the loudspeaker components already assembled. The magnetic system is then constructed by placing the magnet 200 in the U-yoke 10 with the washer 210 placed on top of the magnet 200. The magnetic system is then mounted in the loudspeaker 1 in the hole at the centre of the ring 22. Once mounted, there is a gap between the ring 22 and the front cover 90 and a gap between the ring and the magnetic system. The gap between the ring 22 and the front cover is filled with adhesive. The gap between the ring and the magnetic system is filled with adhesive as well. The adhesive is UV hardening glue that is then cured by exposing the glue to UV light.

The cooling plate is then attached to the base 12 of the U-yoke 10 using 2-component glue or another adhesive. The filter capacitor 150 is then electrically connected to the circuitry of the loudspeaker 1. This is done by soldering one terminal of the filter capacitor 150 to one of the conductive tags 130, and the other terminal of the filter capacitor 180 to connector tag 180.

The present invention has been described with reference to preferred embodiments. Modifications to these embodiments, further embodiments and modifications thereof will be apparent to the skilled person and as such are within the scope of the invention.

The invention claimed is:

1. A loudspeaker, including:

a U-yoke holding a magnet, the U-yoke having a base with an upstanding side around the perimeter of the base;

a frame having a ring around the U-yoke, the ring having a U-shaped cross-section with a base of the U forming an inner side of the ring and a top of each side of the U forming an outer side of the ring such that the U-shaped cross-section is orientated with the base of the U abutting the side of the U-yoke;

a diaphragm connected to the frame by a resilient member around the diaphragm, the resilient member and the diaphragm being suspended from the frame;

a first cavity defined by the diaphragm, resilient member, frame and U-yoke;

a wall around the circumference of the frame, the wall sealing a top of the U-shaped cross-section of the ring forming a second cavity between the wall and the ring;

a port in the frame between the first and second cavities, wherein the first and second cavities and the port form a Helmholtz resonator system.

2. A loudspeaker according to claim 1, wherein the Helmholtz resonator system is tuned to 0.5 to 4 times the fundamental resonance frequency of the loudspeaker.

3. A loudspeaker according to claim 2, wherein the Helmholtz resonator system is tuned to within 1.5 to 2 times the fundamental resonance frequency of the loudspeaker.

4. A loudspeaker according to claim 1, wherein the diaphragm is a dome shaped diaphragm.

5. A loudspeaker according to claim 1, wherein the Helmholtz resonator system is a damped Helmholtz resonator system, wherein the Helmholtz resonator system is damped by damping material in the Helmholtz resonator system.

6. A loudspeaker according to claim 5, wherein damping material is in the second cavity, in the first cavity or in the port in the frame.

7. A loudspeaker according to claim 5, wherein the damping material is open cell foam, fibrous material or fabric.

8. A loudspeaker according to claim 5, wherein the port is sized to induce air flow losses in the port.

9. A loudspeaker according to claim 1, wherein the frame is made of UV-transparent plastic.

10. A loudspeaker according to claim 1, wherein there is a venting hole between the Helmholtz resonator system and the exterior of the loudspeaker, wherein the venting hole is between the first cavity and the exterior of the loudspeaker.

11. A loudspeaker according to claim 10, wherein there are a plurality of venting holes, wherein the loudspeaker is mounted on a body, the loudspeaker having a first venting hole and second venting hole, wherein in use the first venting hole is higher than the second venting hole such that air is drawn through the loudspeaker due to the Chimney Effect.

12. A loudspeaker according to claim 11, wherein the loudspeaker has a plurality of first venting holes and/or a plurality of second venting holes.

13. A loudspeaker according to claim 1, wherein a lead wire from a loudspeaker voice coil is electrically connected to an end of a conductive tag in the first cavity, the conductive tag having an opposing end at the exterior of the loudspeaker, wherein the conductive tag is orientated through the frame from one side of U-shaped cross-section of the ring to the other.

14. A loudspeaker according to claim 1, further including a filter capacitor for reducing the bandwidth of the loudspeaker, wherein the filter capacitor is located in a holder in the frame in part of the ring, the holder being acoustically isolated from the Helmholtz resonator system.

15. A loudspeaker according to claim 14, wherein a long axis of the filter capacitor is orientated out of a plane of the ring, the capacitor protruding from a back of the loudspeaker distal to the diaphragm.

16. A loudspeaker according to claim 1, further comprising a cooling device connected to the U-yoke, the cooling device having a larger surface area exposed to the exterior of the loudspeaker than the U-yoke.

17. A loudspeaker according to claim 16, wherein the cooling device is a plate attached to the base of the U-yoke, wherein the plate is bent or ribbed.

18. A loudspeaker according to claim 1, wherein a front cover for protecting a dome of the loudspeaker is located over the dome and is connected to the wall of the loudspeaker.

19. A method of manufacturing a loudspeaker, including the steps:

mounting a frame on a centring jig, the frame having a ring with a U-shaped cross-section with a base of the U forming an inner side of the ring and a top of each side of the U forming an outer side of the ring;

putting a coil on the centring jig;

putting adhesive on an edge of a diaphragm and an outer edge of a resilient member around the diaphragm;

placing the edge of the diaphragm on the coil and the resilient member on the frame;

curing the adhesive;

mounting a wall around the outer side of the ring;

mounting a U-yoke magnetic system within the inner side of the ring, the U-yoke magnetic system having a U-yoke holding a magnet, wherein the U-yoke has a base with an upstanding side around the perimeter of the base, the upstanding side abutting the inner side of the ring;

applying adhesive between the wall and the ring, and between the ring and the U-yoke magnetic system; and curing the adhesive, wherein a first cavity is formed by the diaphragm, resilient member, frame and U-yoke, and there is a second cavity between the wall and the frame, and wherein there is a port in the frame between the first and second cavities, the first and second cavities and the port forming a Helmholtz resonator system.

20. A method of manufacturing a loudspeaker according to claim 19, wherein the Helmholtz resonator system is tuned to within 1.5 to 2 times the fundamental resonance frequency of the loudspeaker.

* * * * *